US007550686B2

(12) United States Patent
Girke et al.

(10) Patent No.: US 7,550,686 B2
(45) Date of Patent: Jun. 23, 2009

(54) ROTARY SWITCH IN A MOTOR VEHICLE

(75) Inventors: Juergen Girke, Reichenau (DE); Klaus Mueller, Aach (DE); Josef Ferstl, Saal (DE)

(73) Assignee: TRW Automotive Electronics & Components GmbH & Co., KG, Radolfzell (DE)

( * ) Notice: Subject to any disclaimer, the term of this patent is extended or adjusted under 35 U.S.C. 154(b) by 97 days.

(21) Appl. No.: 10/571,632

(22) PCT Filed: Sep. 15, 2004

(86) PCT No.: PCT/EP2004/010357

§ 371 (c)(1),
(2), (4) Date: Mar. 6, 2007

(87) PCT Pub. No.: WO2005/034158

PCT Pub. Date: Apr. 14, 2005

(65) Prior Publication Data

US 2007/0272524 A1 Nov. 29, 2007

(30) Foreign Application Priority Data

Sep. 16, 2003 (DE) ..... 203 14 364 U

(51) Int. Cl.
*H01H 19/58* (2006.01)

(52) U.S. Cl. ..... 200/11 R; 200/336

(58) Field of Classification Search ..... 200/4, 200/5 R, 14, 11 R, 17 R, 18, 336; 345/184
See application file for complete search history.

(56) References Cited

U.S. PATENT DOCUMENTS

| | | | | |
|---|---|---|---|---|
| 3,699,279 | A * | 10/1972 | Lockard et al. | 200/11 G |
| 5,481,637 | A | 1/1996 | Whitehead | |
| 6,262,378 | B1 * | 7/2001 | Chou | 200/4 |
| 6,420,667 | B1 * | 7/2002 | Miwa et al. | 200/4 |
| 6,578,447 | B1 | 6/2003 | Fraser | |
| 6,610,937 | B2 * | 8/2003 | Yamaguchi | 200/4 |
| 7,059,735 | B2 * | 6/2006 | Orikasa | 362/23 |
| 7,087,848 | B1 * | 8/2006 | Yamasaki et al. | 200/6 A |
| 7,297,889 | B2 * | 11/2007 | Bornhorst et al. | 200/336 |
| 7,310,084 | B2 * | 12/2007 | Shitanaka et al. | 345/156 |
| 2002/0023826 | A1 * | 2/2002 | Miwa et al. | 200/4 |
| 2002/0097569 | A1 | 7/2002 | Liao et al. | |

FOREIGN PATENT DOCUMENTS

| | | |
|---|---|---|
| DE | 70 262 01 | 5/1970 |
| DE | 35 33 056 A1 | 3/1987 |
| DE | 195 39 847 C1 | 1/1997 |
| DE | 198 50 681 A1 | 5/2000 |
| DE | 100 30 886 C1 | 2/2002 |

(Continued)

*Primary Examiner*—Michael A Friedhofer
*Assistant Examiner*—Lisa N Klaus
(74) *Attorney, Agent, or Firm*—Tarolli, Sundheim, Covell & Tummino LLP

(57) ABSTRACT

A rotary switch in a motor vehicle has a stationary central part, a rotatable outer part, a control part and a contact unit (16). The control part is coupled to the rotatable outer part so as to transfer a rotary movement of the outer part directly into the contact unit (16).

9 Claims, 4 Drawing Sheets

FOREIGN PATENT DOCUMENTS

| | | | |
|---|---|---|---|
| EP | 0 917 170 | A2 | 5/1999 |
| EP | 0 933 792 | A1 | 8/1999 |
| EP | 1 102 294 | A2 | 5/2001 |
| GB | 1120433 | | 7/1968 |
| JP | 10-294031 | A | 11/1998 |
| JP | 2000-021 266 | A | 1/2000 |

* cited by examiner

ROTARY SWITCH IN A MOTOR VEHICLE

TECHNICAL FIELD

The invention relates to a rotary switch in a motor vehicle, in particular to a rotary switch comprising a stationary central part and a rotatable outer part.

BACKGROUND OF THE INVENTION

Rotary switches in motor vehicles for the selection of particular functions, such as for example light functions (high beams, low beams, parking light etc.) are generally constructed as rotary knobs with a projecting grip part. Such rotary knobs are usually arranged in an operating panel on the dashboard. The rotary knobs are provided with a marking which is manually directed to a symbol corresponding to the desired function. Further, rotary switches are known having a rotatable outer ring. Such rotary switches are used, for example, in operating panels of air-conditioning systems. The rotary movement of the outer ring is transferred via toothed wheels to a switching unit or a contact unit. Such a construction requires a high number of parts and leads to high cumulative tolerances.

It is an object of the invention to provide a small-sized rotary switch with reduced cumulative tolerances.

BRIEF SUMMARY OF THE INVENTION

According to the invention, a rotary switch in a motor vehicle comprises a stationary central part, a rotatable outer part, a control part and a contact unit. The control part is coupled to the outer part so as to transfer the rotary movement of the outer part directly into the contact unit. Such a rotary switch can be realized with a very low overall height, because no grip part is necessary. Owing to the direct introduction of the rotary movement into the contact unit by means of a single component, complicated constructions with toothed wheels or the like can be dispensed with. Especially rotary switches according to the invention used for the controlling of the light functions in a motor vehicle do not require an illumination of the rotatable outer part (with the exception of a possible marking being provided) when the function symbols are arranged in the stationary central part. Accordingly, substantially any desired material scan be used for the components of the rotatable outer part.

DETAILED DESCRIPTION OF THE PREFERRED EMBODIMENT

Figure 1:
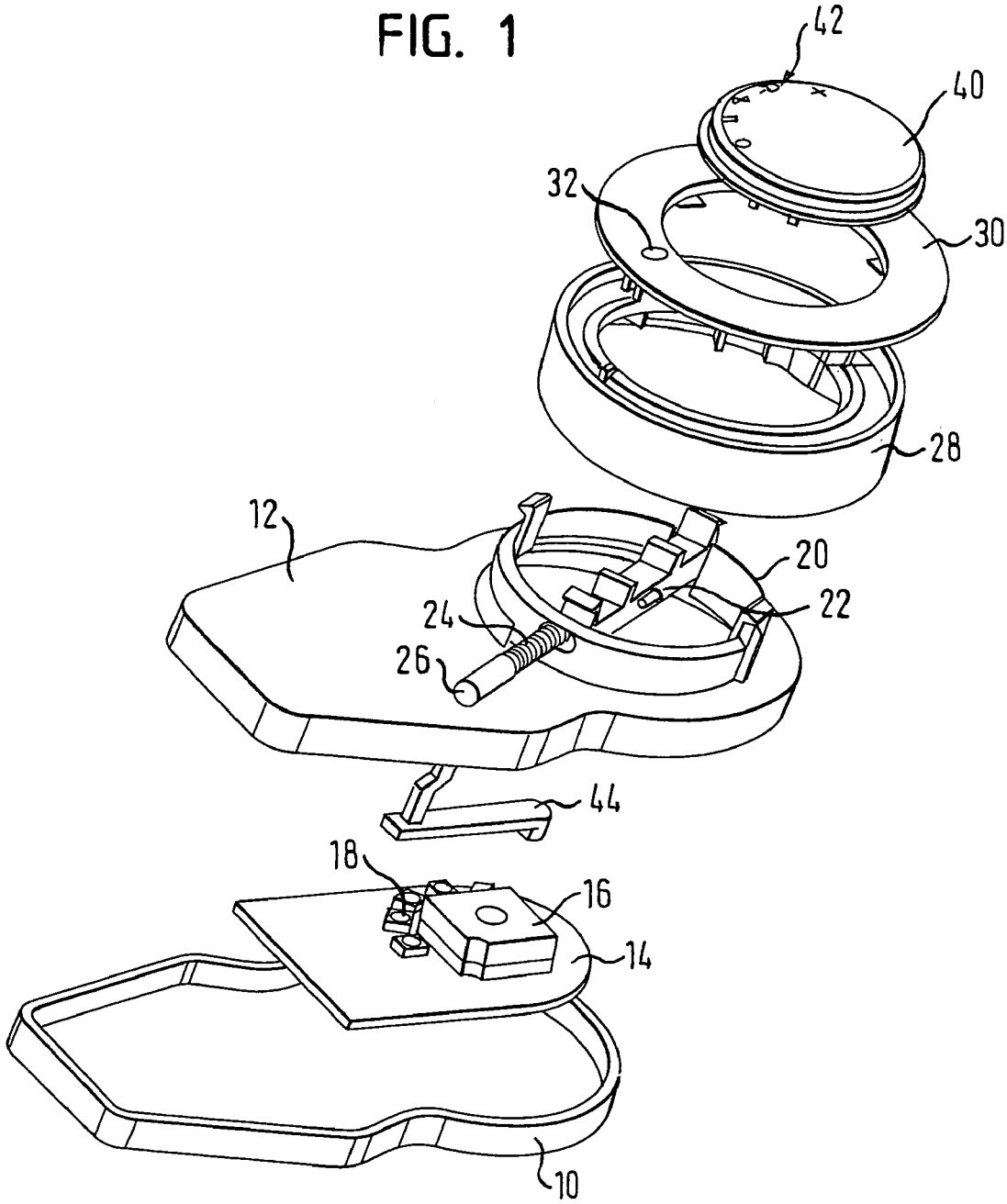
FIG. 1 shows an exploded view of a rotary switch according to the invention.
Figure 2:
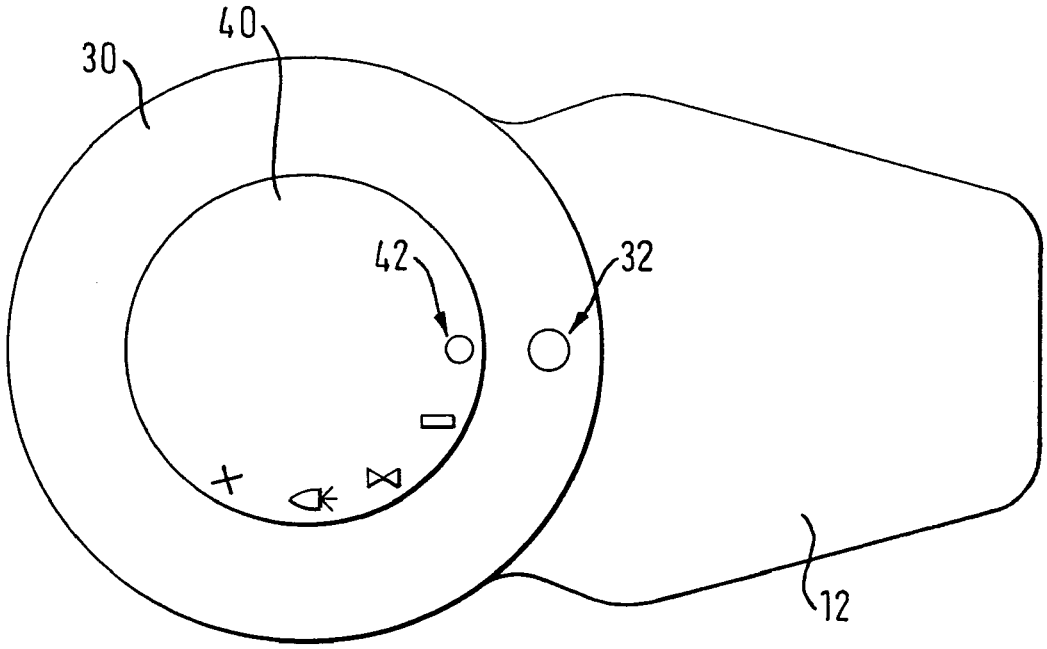
FIG. 2 shows a top view of the rotary switch.

In FIGS. 1 to 4, a rotary switch according to the invention is illustrated, which is provided for selecting the light functions in a motor vehicle. The rotary switch comprises lower and upper housing parts 10 and 12, respectively. Between the housing parts 10, 12 a printed circuit board 14 with a contact unit 16 and several light-emitting diodes 18 is held. The upper housing part 12 has a housing ring part 20 with a diametrical guide 22, in which a helical spring 24 is held (see FIG. 3). At the two ends of the spring 24, detent pins 26 are arranged, which project radially from the housing ring part 20.

Figure 3:
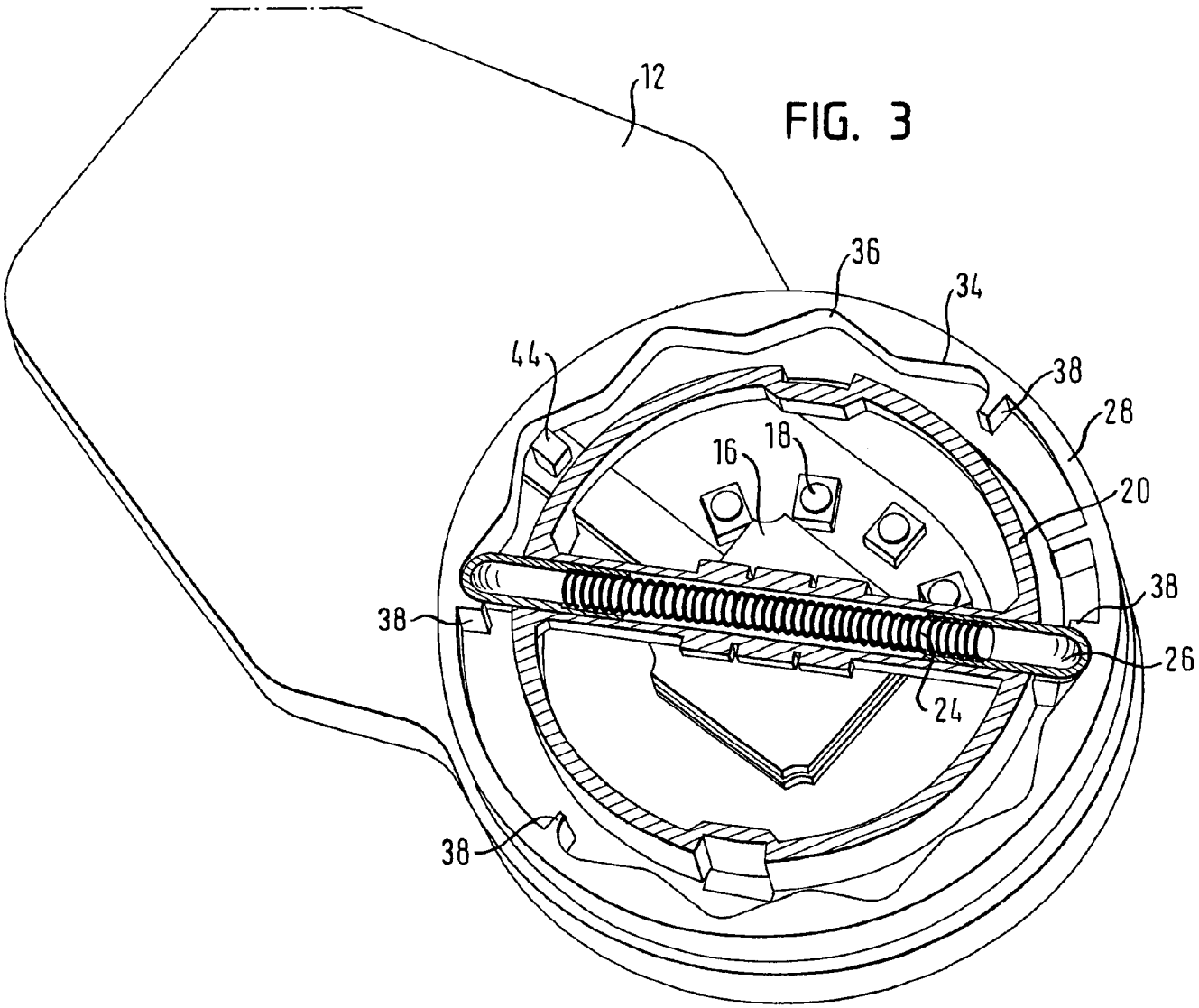
FIG. 3 shows a perspective top view of the rotary switch without the cover and without the rotary ring.
Figure 4:
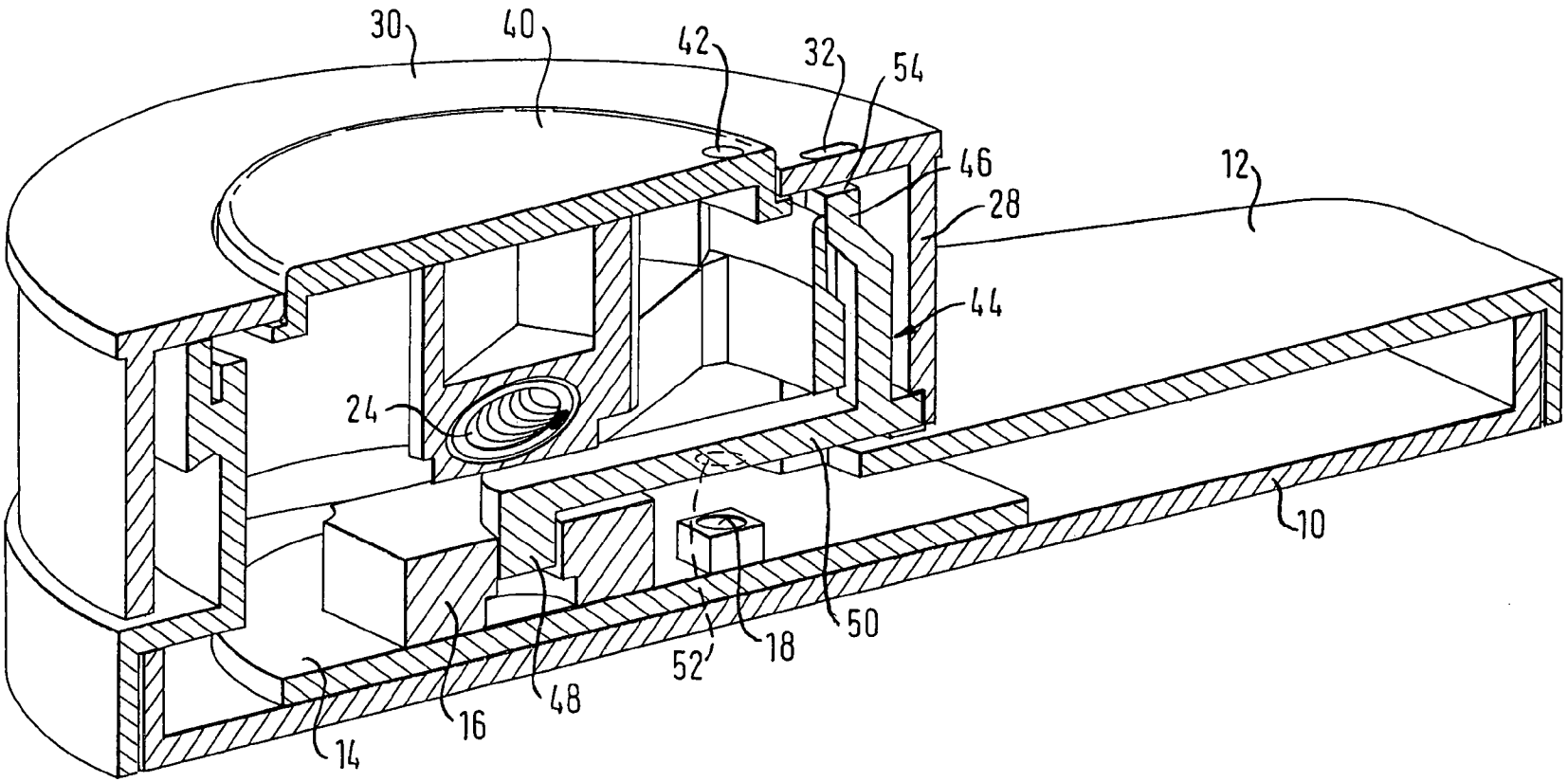
FIG. 4 shows a perspective sectional view of the rotary switch.

An outer ring 28 extends around the housing ring part 20. The outer ring 28, which is clipped onto the housing ring part 20 but is rotatable with respect thereto. A rotary ring 30 with a transparent marking 32 is fitted axially onto the outer ring 28. The outer ring 28 and the rotary ring 30 together form a rotatable outer portion of the rotary switch. In FIG. 3 it can be seen that the outer ring 28 has an undulating inner contour 34. The detent pins 26 are pressed against the undulating contour 34 through the spring 24. The undulation troughs 36 of the inner contour 34 thus form stable detent positions in case of a rotation of the outer ring 28. In the detent positions the spring 24 relaxes, as shown in FIG. 3. A detent position is provided for each function which is able to be controlled with the rotary switch. The undulating contour 34 also has end stops 38, which delimit the rotation of the outer ring 28.

A cover 40 engaging behind the rotary ring 32 is securely connected by clip connections with the housing ring part 20. The cover 40 and the housing ring part 20 together form a central part of the switch which is stationary with respect to the rotatable outer region. The cover 40 has several transparent symbols 42, which represent the various light functions. The rotary switch further comprises a photoconductor lever 44, provided with mirror surfaces on its inside. The photoconductor lever 44 is clipped with a first end 46 on the outer ring 28. The second end 48 of the photoconductor lever 44 engages into the contact unit 16 for controlling a sliding contact. In a cross-section 50 of the photoconductor lever 44, on its lower side opposite the printed circuit board 14, a light inlet opening 52 is provided, which is only indicated diagrammatically in FIG. 4. At the first end 46 of the photoconductor lever 44, a light outlet opening 54 is formed, located opposite the marking 32 of the rotary ring 30.

The mode of operation of the rotary switch is described below. The user selects one of the functions illustrated symbolically on the cover 40, by turning the outer ring 28 relative to the stationary cover 40 into a detent position, in which the marking 32 of the co-rotated rotary ring 30 lies opposite the desired symbol 42. The detent mechanism, formed by the outwardly prestressed detent pins 26 and the inner contour 34 of the outer ring 28, gives the user a responsive feel. The rotary movement is introduced directly into the contact unit 16 via the lever 44. Via the second end 48 of the lever 44, a sliding contact or the like is moved in the contact unit 16. Thus, the corresponding contact connection for the selected light function is produced in the detent position.

The symbols 42 in the cover 40 are permanently illuminated by the light-emitting diodes 18 arranged on the printed circuit board 14. The illumination of the marking 32 on the rotary ring 30 is carried out with the aid of the photoconductor lever 44. The light of the light-emitting diodes 18, which are situated under the transverse section 50 of the photoconductor lever 44, is coupled via the light inlet opening 52 into the photoconductor lever 44 and, with the aid of the inside mirror surfaces, is directed to the first end 46 of the photoconductor lever 44. There, the light emerges from the light outlet opening 54 and impinges on the marking 32. Instead of the mirror surfaces, a photoconducting cable or the like can also be provided. The photoconductor lever 44 has a dual function. Firstly, it serves as a control part which introduces the rotary movement of the outer part of the switch directly into the contact unit 16; secondly, it provides a photoconducting path, via which the light of the light-emitting diodes 18 is directed to the marking 32.

The rotary switch according to the invention was described with the aid of an actual example embodiment in the form of a rotary light switch in a motor vehicle, but is basically also suitable for other applications, in particular in the motor vehicle field.

The invention claimed is:

1. A rotary switch in a motor vehicle, said rotary switch comprising a stationary central part, a rotatable outer part, a control part and a contact unit, said control part being coupled to the rotatable outer part so as to transfer a rotary movement of said outer part directly into said contact unit, symbols being arranged on said stationary central part, said symbols representing the functions able to be selected with said rotary switch, and a marking being arranged on said outer part, said rotary switch further comprising a light source, said control part including a photoconducting path via which light of said light source is directed to said marking.

2. The rotary switch according to claim 1, wherein said control part includes an at least partially hollow lever having a light inlet opening and a light outlet opening.

3. The rotary switch according to claim 2, wherein said lever has inside mirror surfaces.

4. The rotary switch according to claim 2, wherein said symbols are transparent, the rotary switch further comprising a housing in which light-emitting diodes are arranged for illuminating said symbols, said lever being arranged so that light of said light-emitting diodes impinges on said light inlet opening.

5. A rotary switch in a motor vehicle, said rotary switch comprising a stationary central part, a rotatable outer part, a control part and a contact unit, said control part being coupled to the rotatable outer part so as to transfer a rotary movement of said outer part directly into said contact unit, said outer part being formed by an outer ring and an axially fitted rotary ring, said marking being arranged on said rotary ring, said stationary central part including a cover, and said symbols being arranged on said cover.

6. The rotary switch according to claim 5, wherein said symbols are transparent, said rotary switch further comprising a housing in which light-emitting diodes are arranged for illuminating said symbols.

7. The rotary switch according to claim 6, wherein a printed circuit board is held in said housing, said contact unit and said light-emitting diodes being arranged on said printed circuit board.

8. A rotary switch in a motor vehicle, said rotary switch comprising a stationary central part, a rotatable outer part, a control part and a contact unit, said control part being coupled to the rotatable outer part so as to transfer a rotary movement of said outer part directly into said contact unit, said control part being coupled to a sliding contact in said contact unit.

9. A rotary switch in a motor vehicle, said rotary switch comprising a stationary central part, a rotatable outer part, a control part and a contact unit, said control part being coupled to the rotatable outer part so as to transfer a rotary movement of said outer part directly into said contact unit, said rotary switch further comprising a detent mechanism having at least one radially outwardly prestressed detent pin and an inner contour, said detent pin being coupled to said central part, said inner contour being formed in said rotatable outer part and defining detent sites for said detent pin.

* * * * *